US005220907A

United States Patent [19]

Lonsdale

[11] Patent Number: 5,220,907

[45] Date of Patent: Jun. 22, 1993

[54] ARCHERY BOW SIGHT

[76] Inventor: James K. Lonsdale, 12425 N. 66th Ave., Glendale, Ariz. 85304

[21] Appl. No.: 888,729

[22] Filed: May 19, 1992

[51] Int. Cl.[5] ..... F41B 5/00

[52] U.S. Cl. ..... 124/87; 33/265

[58] Field of Search ..... 124/86, 87; 33/265

[56] References Cited

U.S. PATENT DOCUMENTS

| | | | |
|---|---|---|---|
| 3,136,063 | 6/1964 | Stebbins | 124/87 X |
| 3,670,422 | 6/1972 | Stebbins et al. | 33/265 |
| 4,136,462 | 1/1979 | Topel | 33/265 |
| 4,535,544 | 8/1985 | Jones et al. | 33/265 |
| 4,984,372 | 1/1991 | Blizzard | 124/87 X |
| 5,050,576 | 9/1991 | Larson | 124/87 |

OTHER PUBLICATIONS

Bowhunters Discount Warehouse, Fall Edition 1991, p. 80.

*Primary Examiner*—Andrew V. Kundrat
*Assistant Examiner*—Jeffrey L. Thompson
*Attorney, Agent, or Firm*—Gregory J. Nelson

[57] ABSTRACT

A archery bow sight for use with a bow having a body and bow string. The archery sight includes a mounting member for mounting the sight at an intermediate location on the bow, generally in the grip area. A sight frame defines an opening or aperture through which extends at least one fixed cross hair which is generally aligned with the bow string. One or more sub-frames are slidable relative to the fixed frame, each having a generally horizontally extending cross hair. The sub-frames are relatively adjustable so that the individual frames and associated cross hairs may be adjusted for various shooting distances. A level may be associated with the sight to reduce the possibility of cant or tipping.

4 Claims, 2 Drawing Sheets

ARCHERY BOW SIGHT

The present invention relates to sighting device and more particularly to an improved sight for an archery bow. In archery target shooting, the archer must generally compensate for a number of factors. One of the obvious factors is distance from the target and other factors include cross range factors such as wind. In addition, the weight of the arrow and design of the arrow projectile will affect the trajectory and flight of the arrow. Different types of bows have different shooting characteristics and many of the current bows are highly sophisticated compound bows. To compensate for these various factors, the archer must generally shoot one or more arrows in order to determine the necessary sighting adjustments. Accuracy is further complicated in target shooting as the archer will often shoot at targets at different distances. Basically the same situation exists for bow hunters.

Accordingly, to improve the accuracy of the use of archery bows, both when target shooting and hunting, various sighting devices can be found. Compound hunting bows typically are provided with sight holes or attachment points on the bow above the arrow rest for attaching a sight to the bow. Some bows employ both a front and rear sight with some type of adjustment to compensate for varying trajectories or differing drops when targets at various distances are utilized.

For example, the early patent to McNeal, U.S. Pat. No. 3,058,221, shows a bow sight which is vertically adjustable by means of a pivoting arrangement and is horizontally adjustable independently of the bow.

U.S. Pat. No. 4,999,919 discloses an archer's sighting device which uses rubber bands as cross hairs. The positions of the rubber bands are adjustable.

U.S. Pat. Nos. 5,050,576 and 4,136,462 both show bow sights having a vertical wire which may be adjusted for windage and a series of horizontal cross hairs which are adjustable.

U.S. Pat. No. 4,982,503 shows an archery bow sight having front and rear horizontal and vertical cross hairs set within the sights which are mounted on a support member attached to the bow. Shooting pins are provided in the front sight to provide centering points for targets at various distances from the bow.

While the above sights provide the advantage of allowing the archer to compensate for various factors which influence the flight of the arrow, many of these devices have not found wide acceptance, often because of their to complexity, unreliability or necessity for modification to the archery bow.

The present invention provides an archery bow sight which obviates the shortcomings in the bow sights of the prior art providing a bow sight which is easily adjustable by the archery for the particular conditions.

The present bow sight is simple and may be easily transferred from one bow to the other.

Briefly, in accordance with the present invention, the bow sight disclosed which has a side bracket which attaches to the side of the bow and which supports a mounting plate and a sight frame. The sight may be attached to either side of the bow and may be used by both right and left-handed archers. A fixed vertical cross hair extends through an opening in the sight frame. An adjustment mechanism moves the entire sight frame laterally with respect to the mounting plate to adjust the position of the vertical cross hair and to properly position the sight frame. A fixed horizontal cross hair intersects the fixed vertical cross hair and the position of the fixed horizontal cross hair is adjusted by adjusting the sight frame relative to the mounting plate. Within the sight frame are one or more sub-frames which are preferably in a general C-shaped configuration. Each of the sub-frames or C-frames carries a horizontal cross hair extending between opposite sides of the frame. The individual C-frames or sub-frames and the associated cross hairs are vertically adjustable by adjustment mechanisms such as set screws. The plurality of sub-frames or C-frames may be used to establish sighting conditions for various predetermined fixed distances as encountered in target shooting situations.

Accordingly, it is a broad object of the present invention to provide a bow sight which is simple, reliable and adaptable to most bows to provide the archer with a plurality of settings for various distances and range conditions.

Other objects, advantages and features of the bow sight will become apparent from the following description taken in connection with the accompanying drawings in which.

Figure 1:
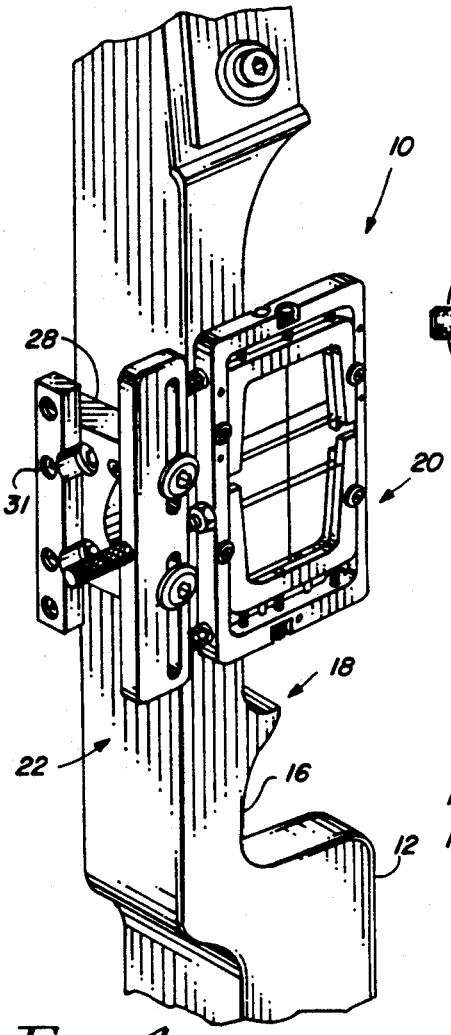
FIG. 1 is a perspective view of a preferred embodiment of the bow sight of the present invention showing the bow sight in conjunction with a typical bow.

Turning now to the drawings, the sight of the present invention is generally designated by the numeral 10. Throughout the drawings, the same reference numerals are used to designate the same components.

The sight 10 is shown in conjunction with a bow 12 having an intermediate grip portion 16. In normal use, the user will grip the bow in the area designated by the numeral 16 placing the arrow against the bow in the arrow rest indicated by numeral 18. The nock of the arrow is pulled rearwardly to draw the bow while the target is sighted through the sight as will be explained. When the target is properly aligned with the selected horizontal and vertical cross hairs, the arrow is released or launched toward the target.

The sight 10 of the present invention as indicated has three principal components; the sight frame 20, mounting plate 22 and side bracket 28. The side bracket includes a mounting plate 26 defining several bores or apertures 30. The side bracket 28 is adapted to abut a planar surface of the side of the grip 16 of the bow. Holes 30 are located so that the mounting plate 28 is secured to the bow by machine screws 31 that extend into tapped and threaded bores in the bow, not shown. The tapped and threaded holes are conventional with most bows. Alternatively, the side bracket 28 may include a clamping mechanism securable to the bow if the archer does not wish to secure the sight by fasteners extending into the bow or if the bow is not provided with tapped holes. The principal components are symmetrical with respect to a horizontal centerline so the sight may be attached to either side of the bow to accommodate right and left-handed archers. The mounting shown is a right-hand configuration.

A circular recess 32 is provided in the face of the side bracket 28 for receipt of a decal or other printed material carrying identifying or instructional information. When mounted, the front surface 34 of the side bracket is generally aligned or slightly forward of the front surface of the grip 16. The terms "forward" and "rearward" as used herein are for reference and "back" or "rear" refers to a direction indicating the back of the bow. "Forward" or "front" refers to the side of the bow on which the bow string is located.

Mounting plate 22 is generally in the shape of an elongate rectangle and is secured at the front edge 34 of the side bracket. Mounting plate 22 is provided with a pair of vertically extending slots 42 and 44 which align with threaded bores 46 depending in the front surface of the side bracket. A pair of screws 48 and 50 extend through the slots into the threaded bores. The slots permit the vertical position of the mounting plate 22 to be adjusted in accordance with the physical requirements of the mounting installation and the personal preference of the individual archer.

Figure 2:
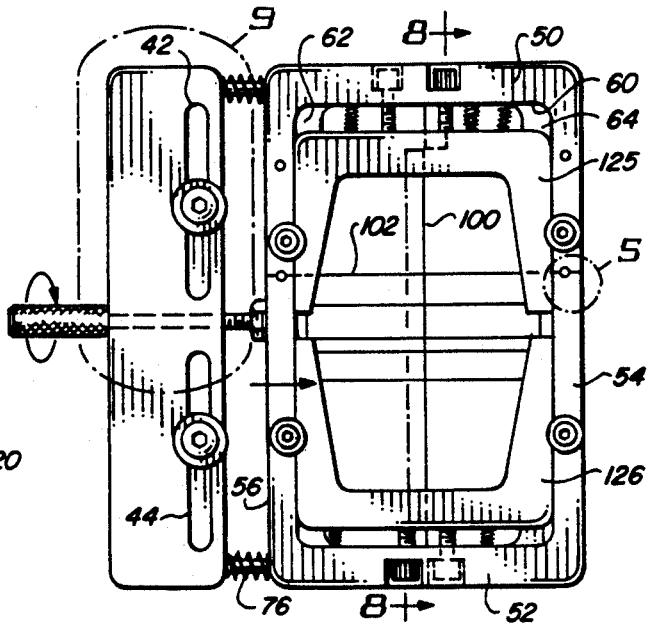
FIG. 2 is a front view of the bow sight of FIG. 1 as seen by the archer in a position of use.
Figure 8:
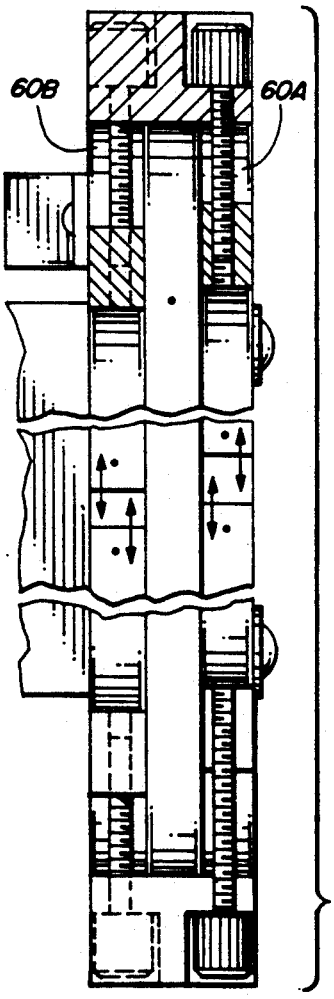
FIG. 8 is a sectional view taken along line 8—8 of FIG. 2.
Figure 9:
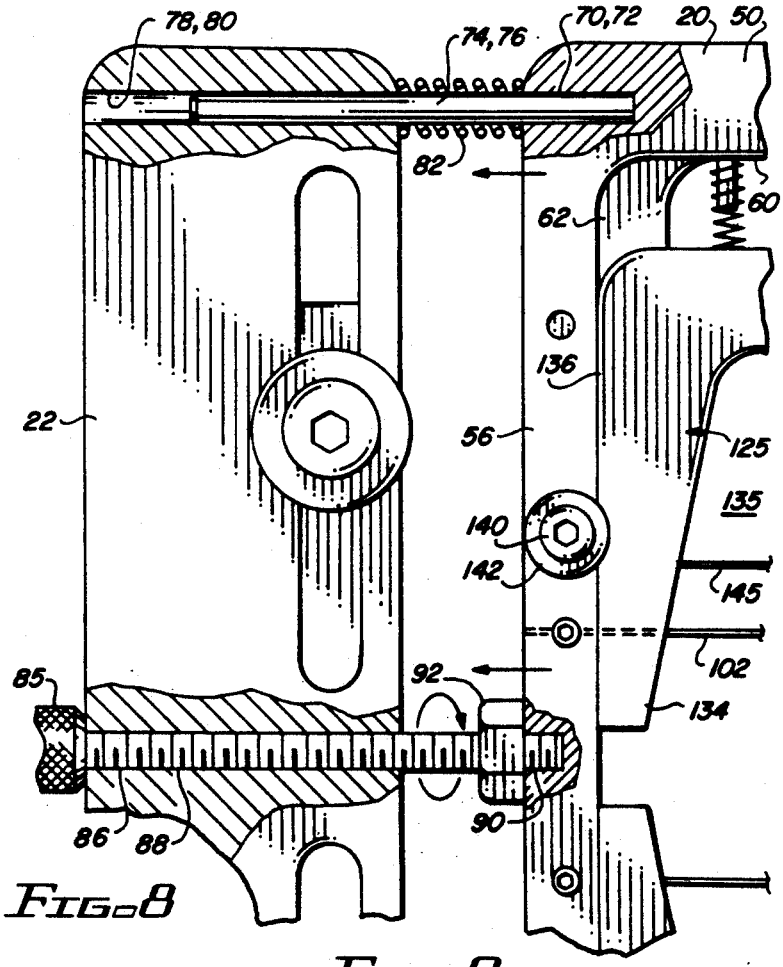
FIG. 9 is a detail view of a portion of the sight as indicated in FIG. 2.

As best seen in FIGS. 2, 8 and 9, the sight frame 20 is adjustably secured to the mounting plate 22 to permit lateral adjustment of the sight frame 20. The sight frame is shown as being generally rectangular having opposite upper and lower sides 50 and 52 and opposite vertical sides 54 and 56 which define a generally rectangular frame about opening 60. A pair of flanges 62 and 64 are disposed at opposite vertical edges of the opening 60. The flanges 62 and 64 have a thickness less than the thickness of the sight frame so that the inner edges of the frame and the rear surface of the flange define a first area 60A on one side of the flange and the inner peripheral edges of the frame and the opposite surface of the flange form a second area 60B at the rear of the frame.

The frame 20 is supported on the mounting plate 22 and is laterally adjustable with respect to the mounting plate. As seen in FIGS. 2 and 9, a blind bore 70 extends laterally into the upper side 50 of the frame from side 56. A similar bore 72 is provided in the lower side of the frame. A pair of spaced-apart pins or rods 74 and 76 extend laterally from the bores at the side 56 of the sight frame. The rods or pins extend into bores 78, 80 in the edge of the mounting plate. Compression spring 82 is interposed between the adjacent sides of the mounting plate and sight frame.

Lateral adjustment of the sight frame relative to the mounting plate is achieved by rotation of adjustment member 85 located at the side of the mounting plate. The adjustment member has an elongate threaded body 86 which extends through a bore 88 which extends transversely through mounting plate 22. A portion of the end of the threaded body is received in a threaded blind bore 90 in the side 56 of the sight plate. A lock nut 92 is provided along the body of the threaded member intermediate the support plate and sight plate. It will be seen that by turning adjustment member 85 the relative lateral position of the sight frame to the mounting plate and bow can be adjusted. Once the desired position is established, lock nut 92 can be tightened to engage the side of the sight frame to prevent further movement.

Figure 5:
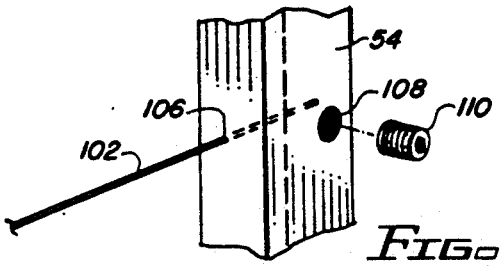
FIG. 5 is enlarged detail view showing the attachment of the fixed horizontal cross hair to the sight frame as indicated in FIG. 2.
Figure 6:
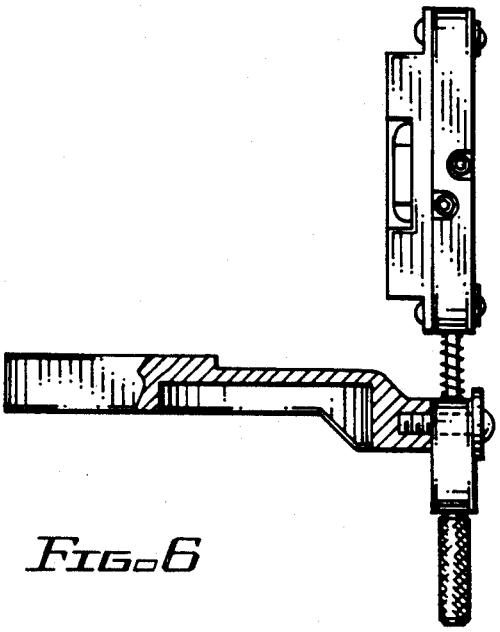
FIG. 6 is a top view of the archery sight of the present invention.

The sight frame is provided with both a vertical cross hair 100 and a horizontal cross hair 102 which are fixed with respect to the frame. Horizontal cross hair 102 is in the form of a small diameter, rigid wire having opposite ends depending into a small bore 106 centrally located at the opposite edges 54 and 56 of the frame. As illustrated in FIG. 5, which is representative of the securement of the ends of both the fixed vertical cross hair 100 and fixed horizontal cross hair 102, a threaded bore 108 intercepts the bore 106. A set screw 110 is in threaded engagement with bore 108 and may be tightened to secure the end of the cross hair in place. The vertical cross hair 100 is secured to the frame in a similar manner at set screws 112 and 114. If a cross hair breaks or becomes damaged, it may easily be replaced.

Figure 3:
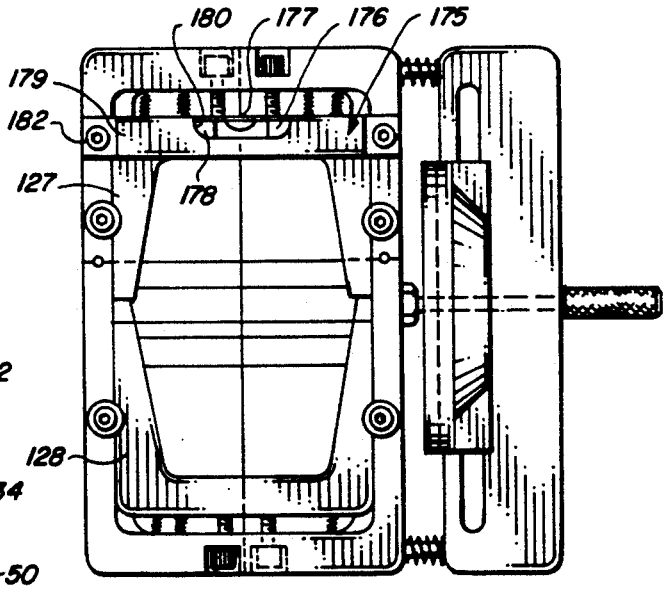
FIG. 3 is a view of the rear of the bow sight removed from the bow for purposes of clarity.
Figure 4:
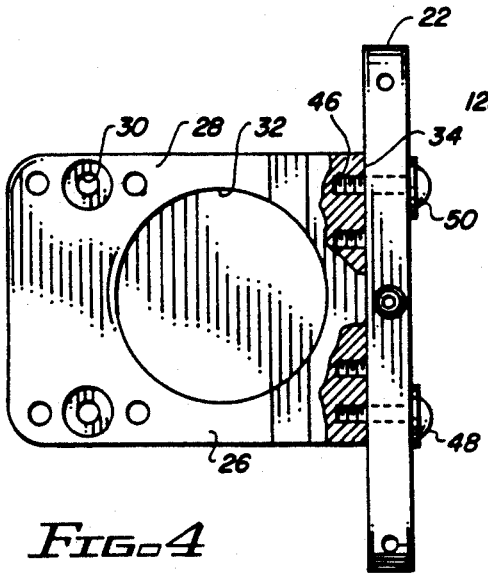
FIG. 4 is a side view of the mounting bracket.
Figure 7:
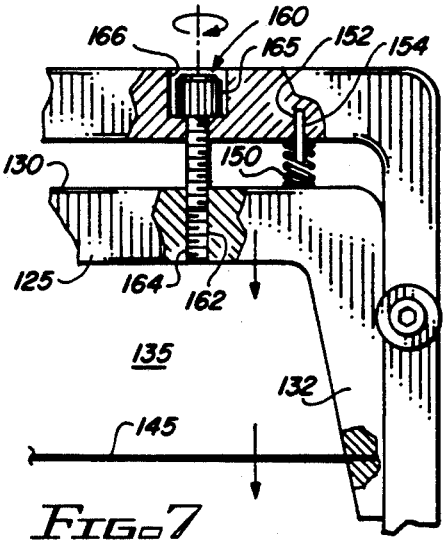
FIG. 7 is a detail view partly broken away of a portion of the sight frame and sub-frame of the archery sight.

The horizontally adjustable cross hairs are mounted on a plurality of subframes designated as C-frames 125, 126, 127 and 128, as best seen in FIGS. 2 and 3. FIGS. 7 and 9 illustrate in detail a portion of sub-frame 125 which is representative of the construction of all of the sub-frames. Each of the C-frames has a horizontally extending bight section 130 with depending legs 132 and 134 at opposite ends of the bight section. The legs each have an outer edge 136 which is in sliding engagement with the interior surface of the associated side of the sight frame.

The C-frame defines a window 135 through which the archer views the target. The individual C-frames are slidable with respect to the larger sight frame and are secured for sliding movement by mechanical fasteners 140 which are in threaded engagement with the side edges of the sight frame. A washer 142 of a low friction material such as Teflon or similar material overlaps the interface between the C-frame and sight frame so as to allow the sight frame to be vertically adjusted to adjust the relative position of the cross hair. For example, C-frame 125 has a cross hair 145 extending between the opposite legs of the frame near the distal ends of these members. The cross hair is a rigid wire and preferably the adjustable cross hair associated with each of the C-frames 125, 126, 127 and 128 is of a different color to assist the archer in selecting the appropriate cross hair for the target distance.

One or more compression springs 150 are interposed between the inner edge of the sight frame and bight portion 130 of the C-frame. The springs are retained in place by depending pins 152 extending from a small bore 154 in the sight frame.

Adjustability is accomplished by adjustment member 160 which has an axially threaded body 162 which engages threaded bore 164 in the bight portion of the C-frame. The opposite end of the body 164 carries a head 165 which is received in the recess 166 in the sight frame. Head 165 defines a recess which will accept a small tool such as an Allen wrench. Thus, as indicated in FIG. 7, rotation of adjustment member 160 will move the C-frame 125 vertically with respect to the sight frame to adjust the relative vertical position of the horizontal cross hair 145. C-frame 125 is disposed in the upper portion of the sight frame in the recess 60A. Similarly, C-frame 126 is disposed in the lower portion of recess 60A at the rear of the sight as seen in FIG. 2 with a space defined between the ends of their respective legs.

As best illustrated in FIG. 3, frames 127 and 128 are similarly disposed on the front side of the sight within the recess 60B. Thus, C-frames 125 through 128 each provide a mounting for a horizontal cross hair which may be selectively adjusted by the archer. The C-frame defines a viewing window 135 within the larger sight frame. The archer views the target through this window. The individual cross hairs are set for targets located at various fixed distances from the archer as for example 20 yards, 40 yards, etc. The adjustment of frames 126 through 128 is accomplished by means of adjusting screws 162, 163 and 164 which are identical to adjustment member 160. Accordingly, detailed description of these components is not believed necessary.

In order to assist the archer in eliminating cant when using the bow, an optional level 175 may be provided in connection with the sight. The level has a transparent tube 176 housing fluid containing bubble 177. Marks or indicia 178 indicate a level position when the bubble is positioned between the marks. The tube 176 is within a housing 179 having a cut-out or window 180 to expose the bubble and markings. The housing 179 is secured at its opposite ends to the side edges of the sight frame at a location at the upper end of the viewing window by screws 182.

In use, the sight is first fixed to the bow at a selected location on the grip which is generally established by the location of pre-tapped holes provided in the bow. The sight may be positioned at opposite sides of the bow by simply inverting and reviewing the sight. The sight is secured at the appropriate location at side bracket 28 and care should be taken so that the fixed vertical cross hair 100 aligns with the bow string. Once the side bracket is in position, the sight frame is adjusted so the fixed cross hairs 100 and 102 are approximately positioned for a predetermined target yardage, generally a short yardage, typically 10 or 20 yards. The position of the vertical cross hair 100 is adjusted by adjustment member 85. Turning adjustment member 85 in one direction to the other will cause the entire sight frame to move laterally until the desired position is achieved. Similarly, the position of the sight frame and the location of the fixed horizontal cross hair 102 is adjustable by loosening screws 48 and 50 and vertically sliding the mounting plate and sight frame to the desired position and thereafter tightening the screws. The archer will normally use the bow by placing the arrow in the arrow rest and engaging the nock of the arrow with the string and pulling the string away from the bow. The archer will pull the bow to the same anchor point for a shot which anchor is generally at a location on the face of the archer such as on the cheek or jaw of the archer. The correctness of the adjustment of the fixed vertical and horizontal cross hair is determined by shooting one or more arrows. Once it has been confirmed that the fixed cross hairs are in the proper location, the various adjustable cross hairs carried on the C-frames are adjusted in accordance with different shooting yardage to be set for the particular bow. For example, sight frame 125 may be set at a shooting yardage of 40 yards with frame 126 for 30 yards, 127 for 20 yards and 128 for 10 yards. The adjustment of the individual frames is achieved by trial and error with the archer shooting an arrow and then making the precise adjustment by turning the appropriate adjusting screw, as for example screw 160. Windage adjustment for downrange conditions may be accomplished by adjustment of vertical cross hair 100 by adjustment knob 85.

It will be obvious to those skilled in the art to make various changes, alterations and modifications to the sight for an archery bow described herein. To the extent such changes, alterations and modifications do not depart from the spirit and scope of the appended claims, they are intended to be encompassed therein.

I claim:

1. A sight for use with an archery bow of the type having a body and a bow string, said body defining a grip portion at an intermediate location, said sight comprising:

(a) a mounting member attachable to said bow at the grip portion, said mounting member including a mounting plate disposed at the front side of the grip portion, said mounting plate defining at least one elongate slot with a fastener extending therein to provide vertical adjustability for the mounting plate;

(b) a fixed sight frame having opposite side edges, a top and bottom edge defining an opening therein, said sight frame including at least one fixed, generally vertically extending cross hair;

(c) first adjustment means extending between said mounting member and said sight frame to permit the position of the sight frame to be adjusted relative to the mounting plate;

(d) at least one sub-frame slidably positioned in said opening, said sub-frame including a generally horizontally extending bight section and legs depending at opposite ends of the bight section, said legs in slidable engagement with the opposite side edges of said sight frame, and a cross hair extending between said legs and intersecting said fixed vertical cross hair, and second adjustment means for adjusting the position of said sub-frame relative to said sight frame.

2. The bow sight of claim 1 wherein said second adjustment means comprises a set screw disposed in an edge of said sight frame and having a threaded body member engaging a threaded bore in said sub-frame.

3. The bow sight of claim 2 further including a level member associated with said sight having indicia thereon indicating a level position, said indicia being viewable by an archer in the normal position of use.

4. A sight for an archery bow having a body defining a grip portion and a bow string attached to said body, said sight comprising:

(a) a mounting member attachable to said bow at a selected location;

(b) a sight frame adjustably attachable to said mounting member and defining a sight frame opening through which the archer may sight a target;

(c) said sight frame having at least a first fixed cross hair extending vertically generally in alignment with the bow string;

(d) said sight frame receiving a plurality of sub-frames each defining a target viewing window and wherein each of said sub-frames is generally C-shaped having a bight section with legs depending therefrom at opposite ends of the bight section, said sub-frames each including a cross hair extending generally horizontally between said legs;

(e) at least one of said sub-frames being slidable relative to said sight frame; and (f) adjustment means for adjusting the position of said slidable sub-frame and the associated cross hair relative to said sight frame.

* * * * *